US008203490B2

(12) United States Patent
Kwak et al.

(10) Patent No.: US 8,203,490 B2
(45) Date of Patent: Jun. 19, 2012

(54) MULTI-BAND ANTENNA APPARATUS

(75) Inventors: Yong Soo Kwak, Suwon-si (KR); Bum Jin Cho, Hwaseong-si (KR); Joon Ho Byun, Yongin-si (KR); Seong Tae Jeong, Yongin-si (KR); Austin Kim, Seongnam-si (KR); Sung Koo Park, Suwon-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 337 days.

(21) Appl. No.: 12/755,780

(22) Filed: Apr. 7, 2010

(65) Prior Publication Data

US 2010/0265152 A1 Oct. 21, 2010

(30) Foreign Application Priority Data

Apr. 15, 2009 (KR) ..... 10-2009-0032766

(51) Int. Cl.
*H01Q 1/38* (2006.01)

(52) U.S. Cl. ..... 343/700 MS; 343/848

(58) Field of Classification Search ..... 343/700 MS, 343/846, 848

See application file for complete search history.

(56) References Cited

U.S. PATENT DOCUMENTS

| | | | | |
|---|---|---|---|---|
| 6,157,344 | A * | 12/2000 | Bateman et al. | 343/700 MS |
| 6,603,429 | B1 * | 8/2003 | Bancroft et al. | 343/700 MS |
| 6,636,179 | B1 * | 10/2003 | Woo et al. | 343/700 MS |
| 6,657,592 | B2 * | 12/2003 | Dening et al. | 343/700 MS |
| 6,661,380 | B1 * | 12/2003 | Bancroft et al. | 343/700 MS |
| 6,897,817 | B2 * | 5/2005 | Jo et al. | 343/702 |

* cited by examiner

*Primary Examiner* — Tho G Phan
(74) *Attorney, Agent, or Firm* — Jefferson IP Law, LLP

(57) ABSTRACT

A multi-band antenna apparatus using a multiple frequency band is provided. The apparatus includes a substrate body formed in a flat plate structure having a preset thickness and in which at least one dielectric plate is stacked, a power supply line, disposed at the substrate body and connected to an external power source, for forming an electromagnetic field when power is supplied from the external power source, a radiation line, separated from the power supply line using the dielectric plate as the boundary in the substrate body, for forming an overlapping area overlapped with the power supply line along one axis through at least a portion, and for resonating in a frequency band determined according to the overlapping area when the electromagnetic field is formed, and a ground plate disposed in at least one an upper ground area and a lower ground area of the substrate body, for grounding the radiation line by contacting with the radiation line.

20 Claims, 12 Drawing Sheets

MULTI-BAND ANTENNA APPARATUS

PRIORITY

This application claims the benefit under 35 U.S.C. §119 (a) of a Korean patent application filed on Apr. 15, 2009 in the Korean Intellectual Property Office and assigned Serial No. 10-2009-0032766, the entire disclosure of which is hereby incorporated by reference.

BACKGROUND OF THE INVENTION

1. Field of the Invention

The present invention relates to an antenna apparatus. More particularly, the present invention relates to a multi-band antenna apparatus of a Pattern Overlapped Capacitor Antenna (POCA) structure.

2. Description of the Related Art

In a conventional wireless communication system, various multimedia services such as a Global Positioning System (GPS), Bluetooth, and Internet are provided. In this case, in order to provide an efficient multimedia service, a transmission rate for transmitting a large amount of data for the multimedia service at a high speed should be guaranteed. As a result, research for improving performance of an antenna apparatus in a communication terminal is performed because the antenna apparatus substantially transmits and receives data for a multimedia service.

Further, in the wireless communication system, in order to improve portability of the communication terminal, thickness and size of the communication terminal should decrease. When at least a portion of an antenna apparatus such as a road antenna or a helical antenna protrudes from outside the communication terminal, the communication terminal cannot be easily carried and the antenna apparatus may be frequently damaged. Thereby, a built-in antenna apparatus in which the antenna apparatus is mounted within the communication terminal is embodied.

However, with the built-in antenna apparatus within the communication terminal, the antenna apparatus resonates at a relatively narrow frequency band. Consequently, as the communication terminal provides a plurality of antenna devices, an extended frequency band can be used. However, it is difficult to decrease the size of the communication terminal. That is, it is impossible to use various multimedia services in various wireless communication systems through a single antenna device in the communication terminal.

Therefore, a need exists for a multi-band antenna apparatus and a method for extending a frequency band.

SUMMARY OF THE INVENTION

An aspect of the present invention is to address at least the above-mentioned problems and/or disadvantages and to provide at least the advantages described below. Accordingly, an aspect of the present invention is to provide an antenna apparatus that can use a multiple frequency band.

In accordance with an aspect of the present invention, an antenna apparatus that can use a multiple frequency band is provided. The apparatus includes a substrate body formed in a flat plate structure having a preset thickness and in which at least one dielectric plate is stacked, a power supply line, disposed at the substrate body and connected to an external power source, for forming an electromagnetic field when power is supplied from the external power source, a radiation line, separated from the power supply line using the dielectric plate as a boundary in the substrate body, for forming an overlapping area overlapped with the power supply line along one axis through at least an end portion, and for resonating in a frequency band determined according to the overlapping area when the electromagnetic field is formed, and a ground plate, disposed in at least one of both surfaces of the substrate body, for grounding the radiation line while having contact with the radiation line.

The frequency band may be determined through at least one of an area of the overlapping area and a separation thickness of the overlapping area according to the substrate body.

The antenna apparatus may further include a ground line for connecting the radiation line and the ground plate.

In accordance with another aspect of the present invention, an antenna apparatus including a substrate body using a multiple frequency band is provided. The apparatus includes a power supply line, disposed at the substrate body and connected to an external power source, for forming an electromagnetic field when power is supplied from the external power source, a radiation line, separated from the power supply line using the dielectric plate as a boundary in the substrate body, for forming an overlapping area overlapped with the power supply line along one axis through at least an end portion, and for resonating in a frequency band determined according to the overlapping area when the electromagnetic field is formed, a ground plate, disposed in at least one of an upper ground area and a lower ground area of the substrate body, for grounding the radiation line while having contact with the radiation line, and a ground line for connecting the radiation line and the ground plate.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features, and advantages of certain exemplary embodiments of the present invention will be more apparent from the following detailed description taken in conjunction with the accompanying drawings, in which.

Throughout the drawings, it should be noted that like reference numbers are used to depict the same or similar elements, features, and structures.

DETAILED DESCRIPTION OF EXEMPLARY EMBODIMENTS

The following description with reference to the accompanying drawings is provided to assist in a comprehensive understanding of exemplary embodiments of the invention as defined by certain claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention are provided for illustration purpose only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 1:
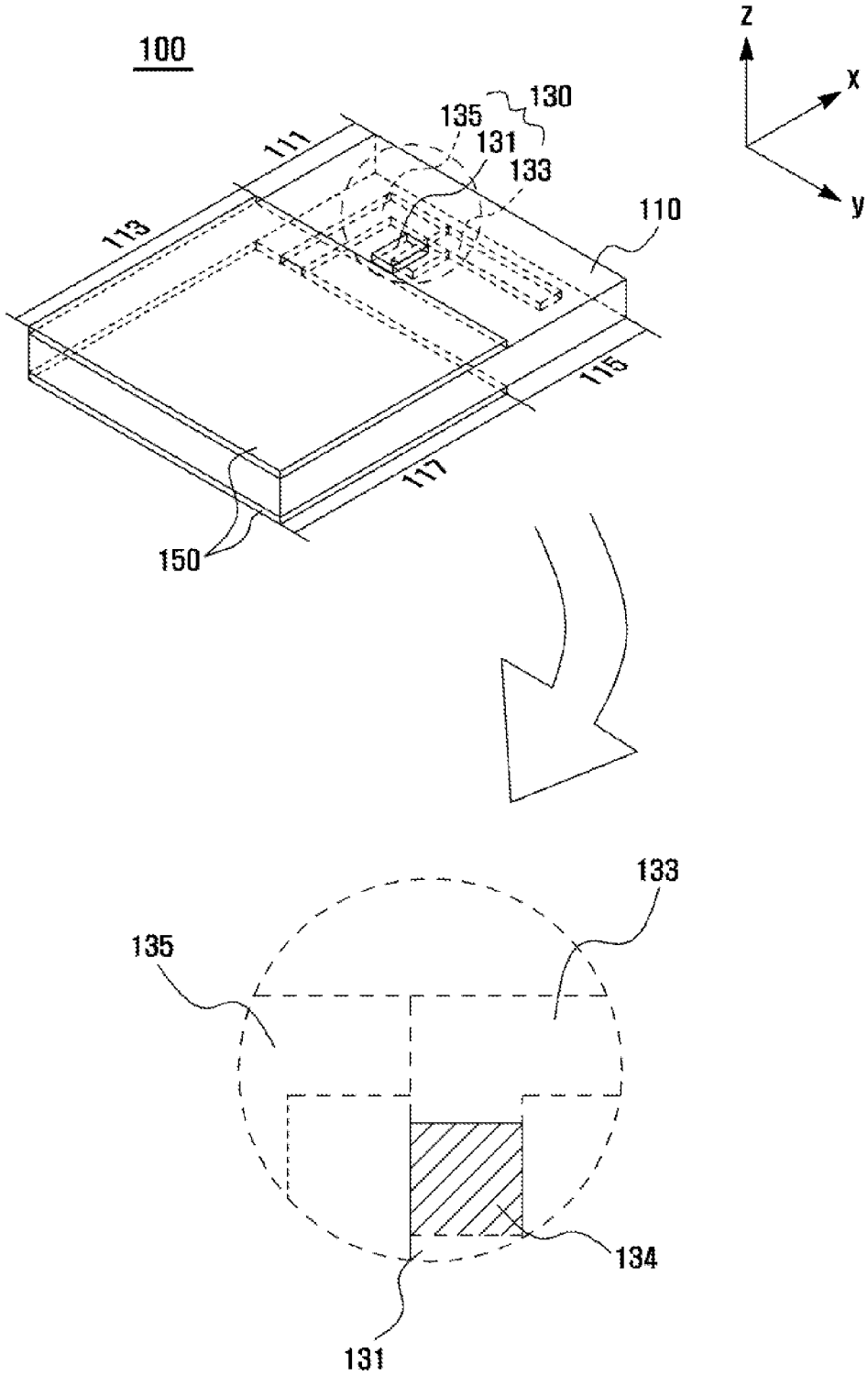
FIG. 1 is a perspective view illustrating an antenna apparatus according to an exemplary embodiment of the present invention.
Figure 2:
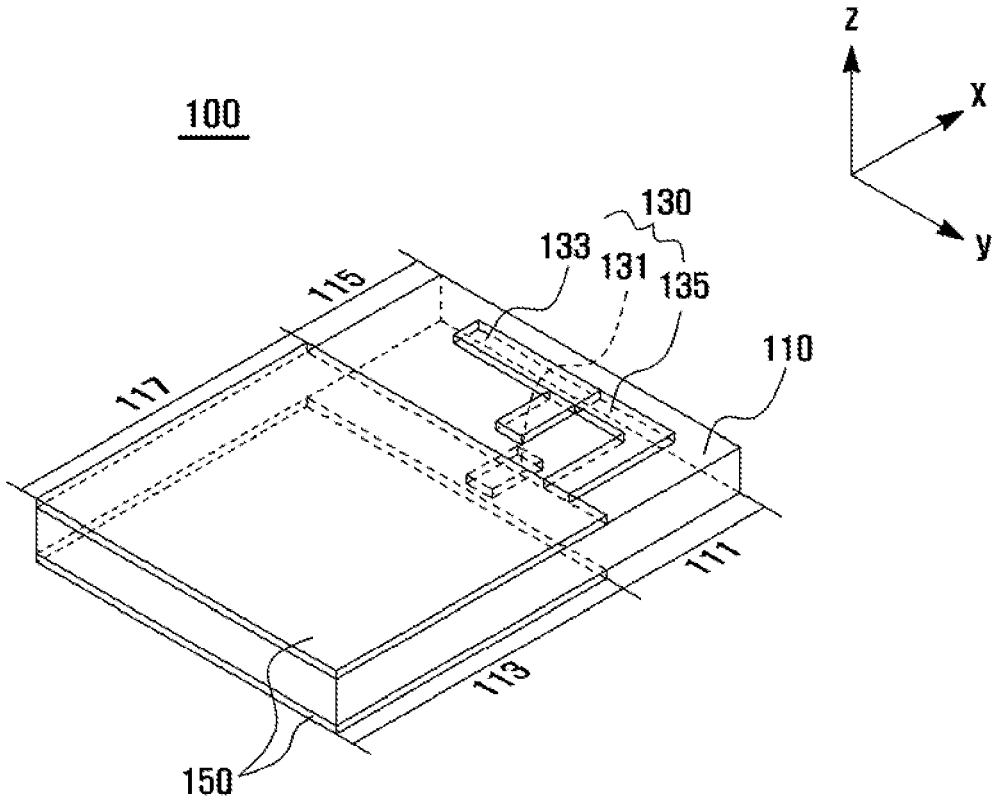
FIG. 2 is a perspective view illustrating a rear surface of an antenna apparatus of according to an exemplary embodiment of the present invention.

FIG. 1 is a perspective view illustrating an antenna apparatus according to an exemplary embodiment of the present invention. FIG. 2 is a perspective view illustrating a rear surface of an antenna apparatus according to an exemplary embodiment of the present invention.

In an exemplary implementation, an antenna apparatus is formed in a Printed Circuit Board (PCB).

Referring to FIGS. 1 and 2, a multi-band antenna apparatus 100 is formed in a Pattern Overlapped Capacitor Antenna (POCA) structure and includes a substrate body 110, antenna device 130 and ground plate 150.

The substrate body 110 is provided to support the antenna apparatus 100. The substrate body 110 is formed in a flat plate structure having both surfaces and at least four corners. The substrate body 110 is formed with a dielectric body. In this case, the substrate body 110 may be formed in a single dielectric plate or may be formed by stacking a plurality of dielectric plates. Further, the substrate body 110 has a transmission line (not illustrated). Here, the transmission line is connected to an external power source (not illustrated) of the antenna apparatus 100 through one end portion.

An upper surface of the substrate body 110 is divided into an upper element area 111 and an upper ground area 113. The upper element area 111 is disposed to include two corners of the upper surface, and the upper ground area 113 is disposed to include the remaining corners of the upper surface. A lower surface of the substrate body 110 is divided into a lower element area 115 and a lower ground area 117. The lower element area 115 is disposed at an area corresponding to the upper element area 111 in the lower surface, and the lower ground area 117 is disposed at an area corresponding to the upper ground area 113 in the lower surface.

The antenna device 130 is provided to transmit and receive a signal of a preset frequency band in the antenna apparatus 100. That is, the antenna device 130 resonates in a preset frequency band, thereby transmitting a signal. In this case, the antenna device 130 resonates in a preset reference impedance. The antenna device 130 is formed in a surface of the substrate body 110, i.e. in the upper element area 111 and the lower element area 115. In this case, the antenna device 130 is formed by patterning a metal material in the surface of the substrate body 110. The antenna device 130 includes a power supply line 131, a radiation line 133 and a ground line 135. As the power supply line 131 and the radiation line 133 are overlapped, the antenna device 130 has a POCA structure.

The power supply line 131 is provided to supply power to the antenna device 130. The power supply line 131 is disposed at the upper element area 111 of the substrate body 110. In this case, the power supply line 131 is connected to another end portion of the transmission line. The power supply line 131 is formed in a bar form extended from the transmission line in an upper surface of the substrate body 110. Alternatively, the power supply line 131 may be formed in a structure having at least one folded portion. The power supply line 131 may be formed in at least one of a meander type, a spiral type, a step type, a loop type, and the like. That is, the power supply line 131 is connected to the transmission line through one end portion and is opened through the other end portion. Accordingly, when power is supplied from an external power source through the transmission line, the power supply line 131 forms an electromagnetic field in a peripheral area within a preset distance.

The radiation line 133 is provided to radiate a signal in the antenna device 130. The radiation line 133 is disposed at the lower element area 115 of the substrate body 110. In this case, the radiation line 133 is separated from the power supply line 131 using the substrate body 110 as a boundary. The radiation line 133 is overlapped with the other end portion of the power supply line 131 along one axis perpendicular to an upper surface of the substrate body 110 through at least another end portion. Further, the radiation line 133 is formed in a bar form extended from the power supply line 131 in a lower surface of the substrate body 110. Alternatively, the radiation line 133 may be formed in a structure having at least one folded portion. The radiation line 133 may be formed in at least one of a meander type, a spiral type, a step type, a loop type, and the like. That is, the radiation line 133 is overlapped with the power supply line 131 through one end portion and is opened through another end portion. Accordingly, when an electromagnetic field is formed in the power supply line 131, the power supply line 131 and the radiation line 133 are in an excited state through the overlapping area 134. That is, electromagnetic coupling is performed between the power supply line 131 and the radiation line 133. Thereby, when power is supplied by the radiation line 133, the power supply line 131 resonates in a preset frequency band.

The ground line 135 is provided to ground in the antenna device 130. The ground line 135 is disposed at the lower element area 115 of the substrate body 110. In this case, the ground line 135 has contact with the radiation line 133 through one end portion and connects the radiation line 133 to the ground plate 150. The ground line 135 is formed in a bar form extended from the radiation line 133 in a lower surface of the substrate body 110. Alternatively, the ground line 135 may be formed in a structure having at least one folded portion. Here, the ground line 135 may be formed in at least one of a meander type, a spiral type, a step type, a loop type, and the like. That is, the ground line 135 has contact with the radiation line 133 through one end portion and has contact with the ground plate 150 through the other end portion.

The antenna device 130 is designed to have intrinsic inductance and capacitance for resonating in a preset frequency band, which is described in more detail with reference to FIG. 3.

Figure 3:
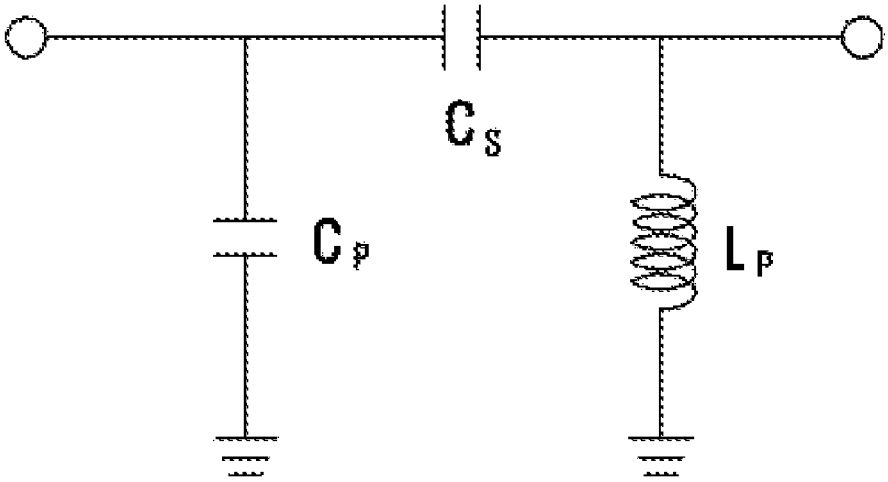
FIG. 3 is a circuit diagram illustrating an equivalent circuit of an antenna apparatus according to an exemplary embodiment of the present invention.

FIG. 3 is a circuit diagram illustrating an equivalent circuit of the antenna apparatus according to an exemplary embodiment of the present invention.

Referring to FIG. 3, in the antenna apparatus 100, an equivalent circuit of the antenna device 130 is formed with a serial capacitor $C_S$, a parallel inductor $L_P$ and a parallel capacitor $C_P$. The serial capacitor $C_S$ is connected in series to an external power source, and the parallel inductor $L_P$ and the parallel capacitor $C_P$ are connected in parallel to the serial capacitor $C_S$.

In this case, in the antenna apparatus 100, a characteristic of an equivalent circuit is determined according to the size or shape of the antenna device 130. For example, a characteristic of the parallel inductor $L_P$ of the antenna device 130 is determined according to a size, i.e., a length and a width of an extension direction of the antenna device 130. A characteristic of the serial capacitor $C_S$ is determined in the antenna device 130 according to a length of a horizontal component of the antenna device 130 parallel to the ground plate 150, a gap of the ground plate 150, and a vertical component of the antenna device 130. Further, in the antenna device 130, a characteristic of the parallel capacitor CP is determined according to a size. That is, a characteristic of the parallel capacitor CP is determined according to an area or a separation thickness of an overlapping area 134 between the power supply line 131 and the radiation line 133, for example, a thickness of the substrate body 110.

The ground plate 150 is provided to ground the antenna apparatus 100. The ground plate 150 is disposed in at least one of the upper ground area 113 and the lower ground area 117 of the substrate body 100. In this case, the ground plate 150 is formed to cover at least one of the upper ground area 113 and the lower ground area 117. The ground plate 150 has contact with the antenna device 130, for example, the ground line 135. Accordingly, when power is supplied to the antenna device 130, the ground plate 150 grounds the antenna device 130.

The operation characteristic of the antenna apparatus 100 according to an exemplary embodiment of the present invention is described in more detail below.

Figure 4:
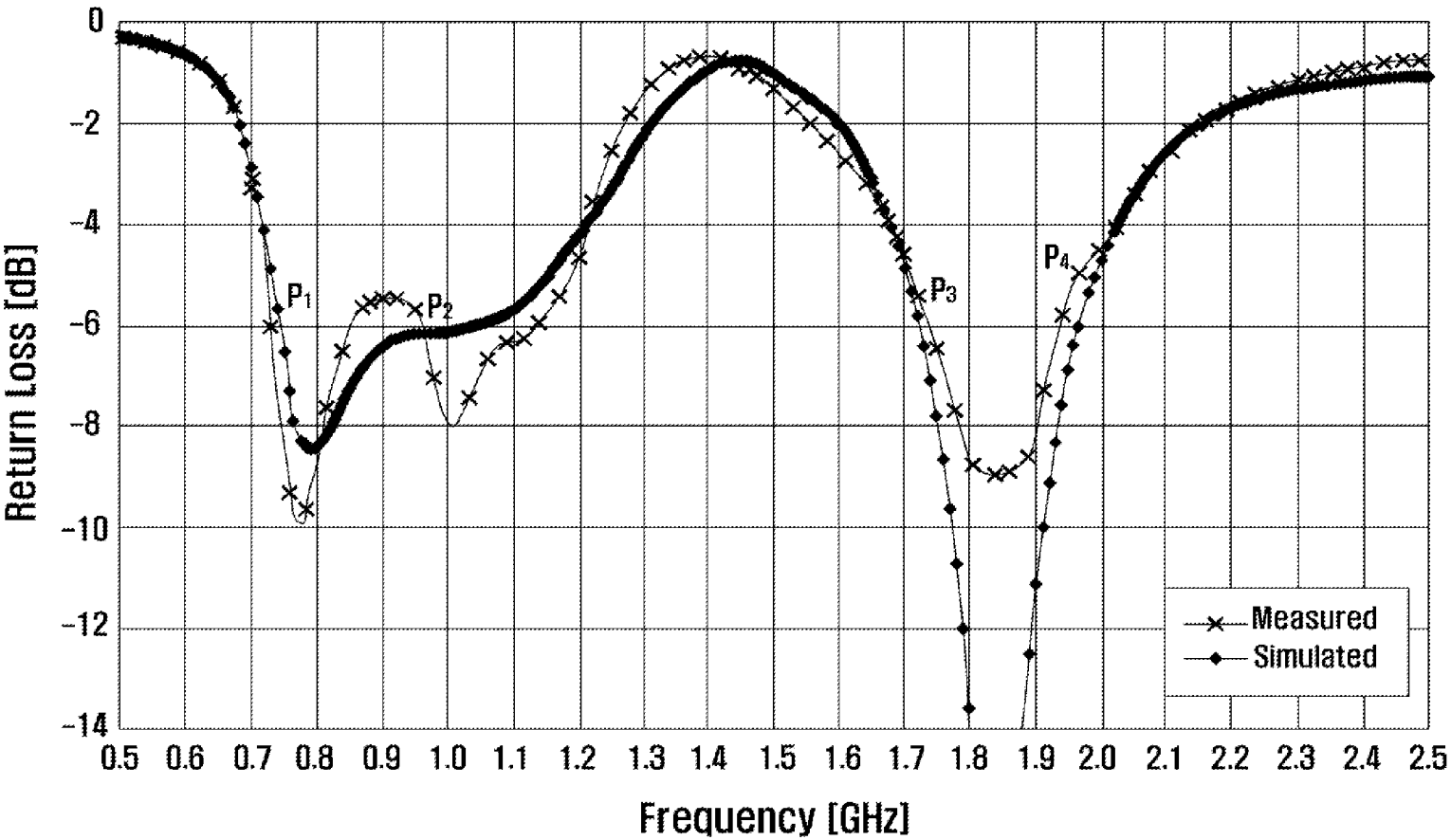
FIG. 4 is a diagram illustrating an operation characteristic of an antenna apparatus according to an exemplary embodiment of the present invention.

FIG. 4 is a diagram illustrating an operation characteristic of the antenna apparatus according to an exemplary embodiment of the present invention.

FIG. 4 represents a change of an S parameter according to a frequency band. Here, the S parameter is an index representing a voltage ratio (i.e., output voltage/input voltage) between an input/output in a specific frequency band and is represented by a dB scale.

Referring to FIG. 4, the antenna apparatus 100 resonates in a plurality of frequency bands. In this case, the antenna apparatus 100 resonates in low frequency bands $P_1$ to $P_2$ including a Long Term Evolution (LTE) communication band corresponding to 746 MHz to 787 MHz, Code Division Multiple Access (CDMA) and Global System for Mobile Communication (GSM) communication bands corresponding to 824 MHz to 894 MHz, and an Extension of GSM (EGSM) communication band corresponding to 880 MHz to 960 MHz. Further, the antenna apparatus 100 resonates in high frequency bands $P_3$ to $P_4$ including a Digital Cordless System (DCS) communication band corresponding to 1,710 MHz to 1,880 MHz and a Personal Communication System (PCS) communication band corresponding to 1,850 MHz to 1,990 MHz.

Figure 5:
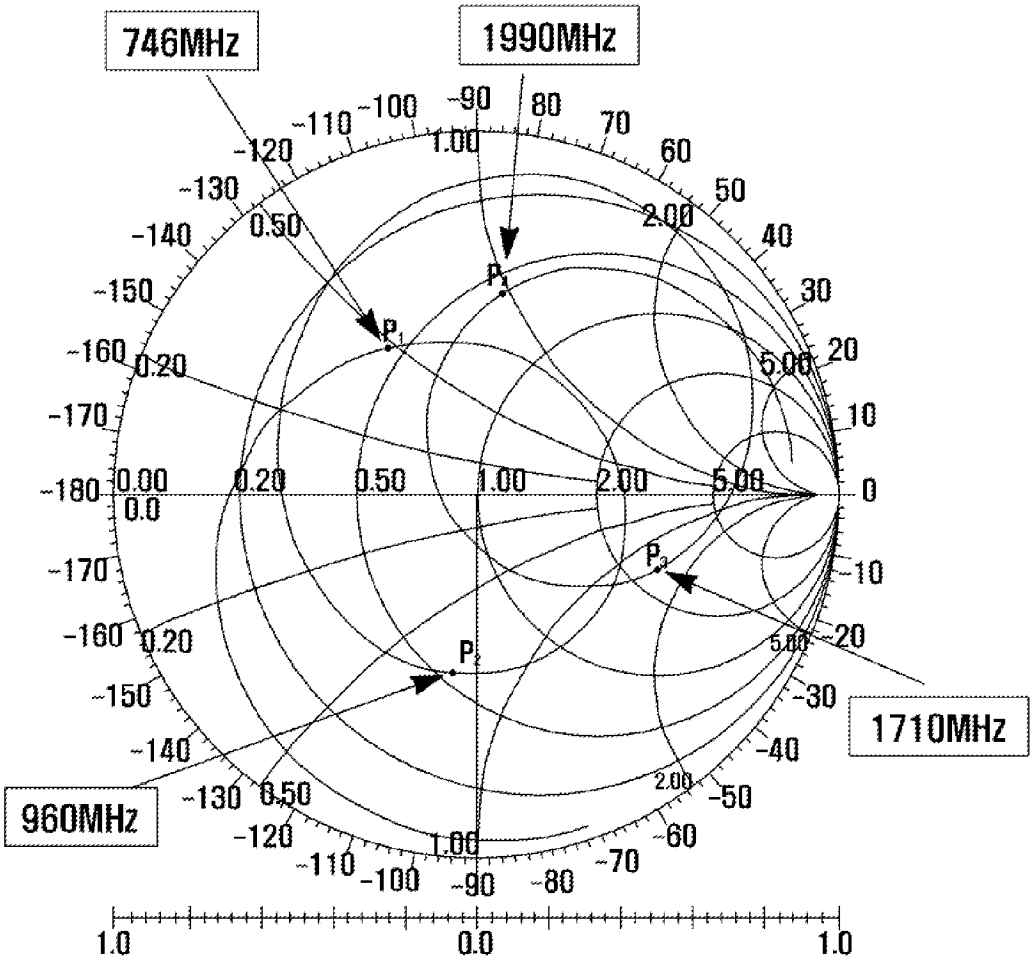
FIG. 5 is a diagram illustrating an operation characteristic of an antenna apparatus according to an exemplary embodiment of the present invention.

FIG. 5 is a diagram illustrating an operation characteristic of an antenna apparatus according to an exemplary embodiment of the present invention.

FIG. 5 illustrates a smith chart. Here, the smith chart is an index representing a relationship between impedance and a reflection coefficient, and has high performance while approaching a central point (1.00).

Referring to FIG. 5, the antenna apparatus 100 resonates in a plurality of frequency bands. In this case, the antenna apparatus 100 resonates with relative high performance in low frequency bands $P_1$ and $P_2$ and high frequency bands $P_3$ and $P_4$. That is, the antenna apparatus 100 operates with relative high performance in each of low frequency bands $P_1$ and $P_2$ corresponding to, for example, 746 MHz to 960 MHz or high frequency bands $P_3$ and $P_4$ corresponding to, for example, 1,710 MHz to 1,990 MHz.

Figure 6:
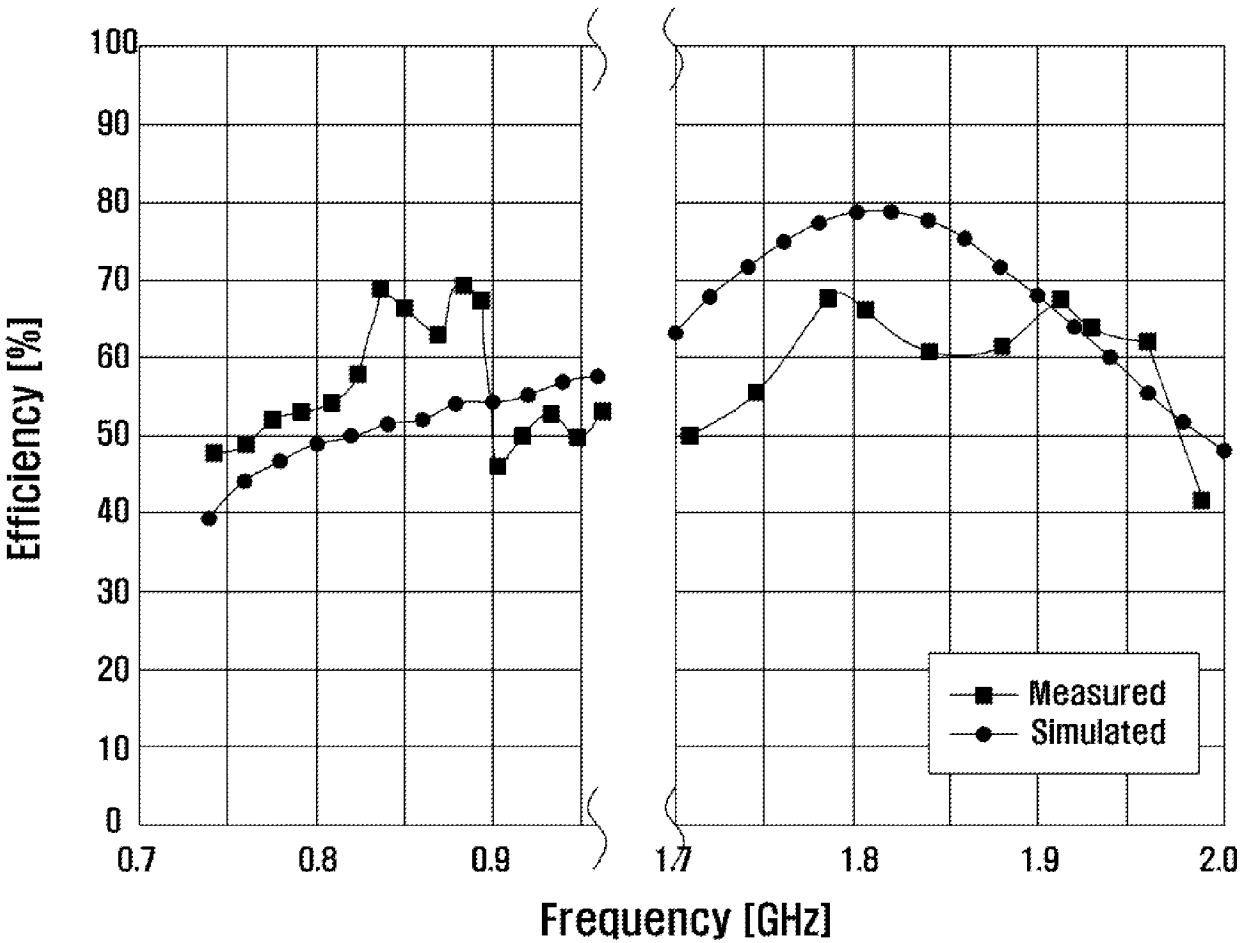
FIG. 6 is a diagram illustrating operation efficiency of an antenna apparatus according to an exemplary embodiment of the present invention.

FIG. 6 is a diagram illustrating operation efficiency of an antenna apparatus according to an exemplary embodiment of the present invention.

Referring to FIG. 6, the antenna apparatus 100 resonates in a plurality of frequency bands. In this case, the antenna apparatus 100 resonates with relative high operation efficiency in low frequency bands $P_1$ and $P_2$ and in high frequency bands $P_3$ and $P_4$. That is, the antenna apparatus 100 resonates with operation efficiency of about 50% or more in each of low frequency bands $P_1$ and $P_2$ corresponding to, for example, 746 MHz to 960 MHz or high frequency bands $P_3$ and $P_4$ corresponding to, for example, 1,710 MHz to 1,990 MHz.

Further, in an exemplary implementation, by tuning the antenna apparatus 100, an operation characteristic may be minutely adjusted.

Figure 7A:
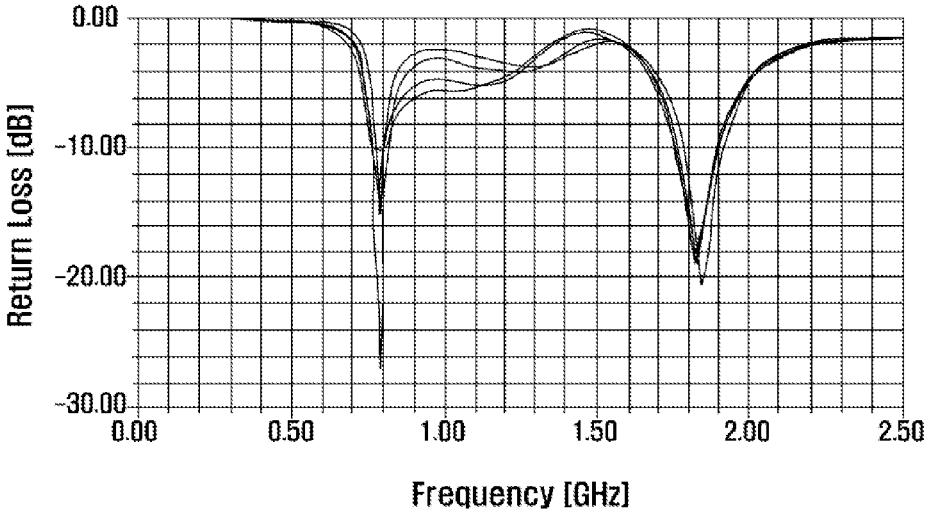
FIGS. 7A and 7B are diagrams illustrating a change of an operation characteristic according to tuning of an antenna apparatus according to exemplary embodiments of the present invention.
Figure 7B:
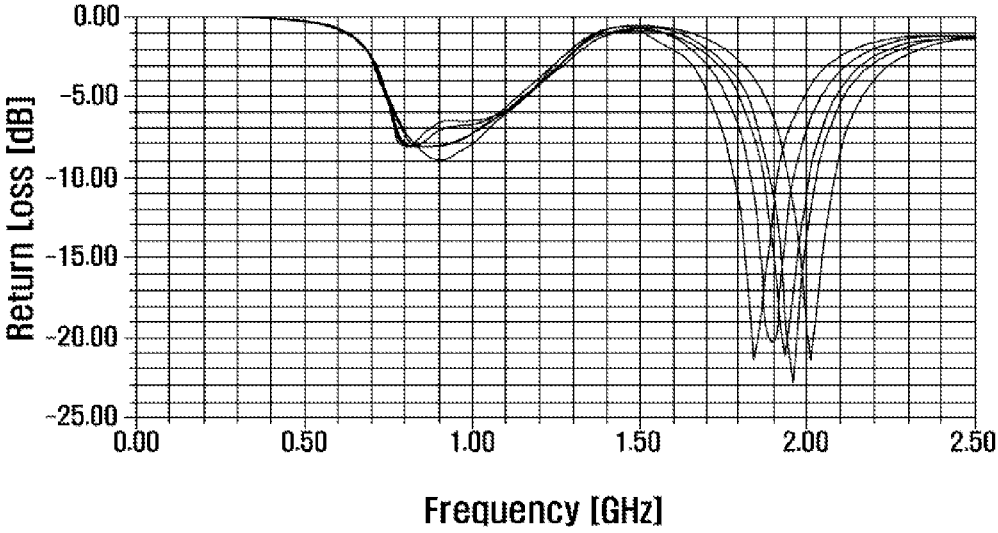

FIGS. 7A and 7B are diagrams illustrating a change of an operation characteristic according to tuning of an antenna apparatus according to an exemplary embodiment of the present invention.

FIGS. 7A and 7B represent a change of an S parameter according to a frequency band.

Referring to FIG. 7A, in the antenna apparatus 100, by adjusting an overlapping area 134 between a power supply line 131 and a radiation line 133, low frequency bands $P_1$ and $P_2$ may be adjusted. In this case, by enlarging or reducing an area of the overlapping area 134 in the antenna apparatus 100, a characteristic of a parallel capacitor CP may be changed. Thereby, in the antenna apparatus 100, a bandwidth of low frequency bands $P_1$ to $P_2$ may be enlarged or reduced, or resonance performance may be improved or deteriorated. In this case, even if the overlapping area 134 between the power supply line 131 and the radiation line 133 is adjusted, high frequency bands $P_3$ and $P_4$ may be sustained without any change.

Referring to FIG. 7B, in the antenna apparatus 100, by adjusting a size of the radiation line 133, high frequency bands $P_3$ and $P_4$ may be adjusted. In this case, in the antenna apparatus 100, by enlarging or reducing a length or a width of the radiation line 133, a characteristic of a parallel inductor $L_P$ or a serial capacitor $C_S$ may be changed. Thereby, in the antenna apparatus 100, a bandwidth of high frequency bands $P_3$ and $P_4$ may be enlarged or reduced, or resonance performance may be improved or deteriorated. In this case, even if a size of the radiation line 133 is adjusted, low frequency bands $P_1$ and $P_2$ may be sustained without any change.

Figure 8:
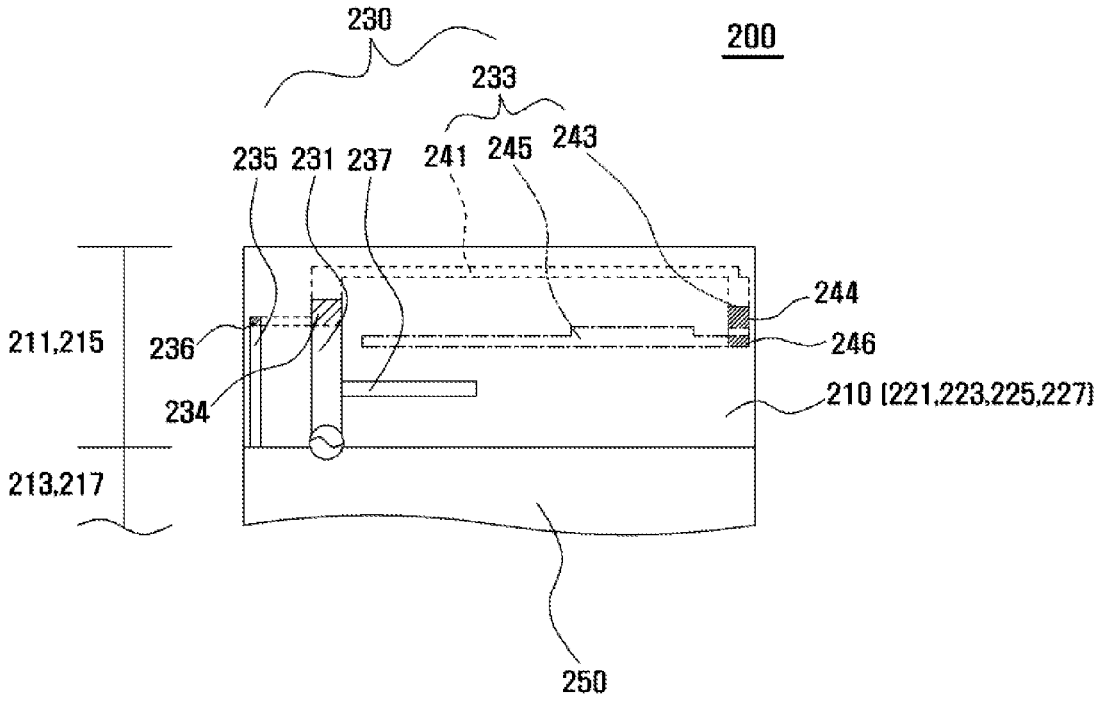
FIG. 8 is a plan view illustrating an antenna apparatus according to an exemplary embodiment of the present invention.
Figure 9:
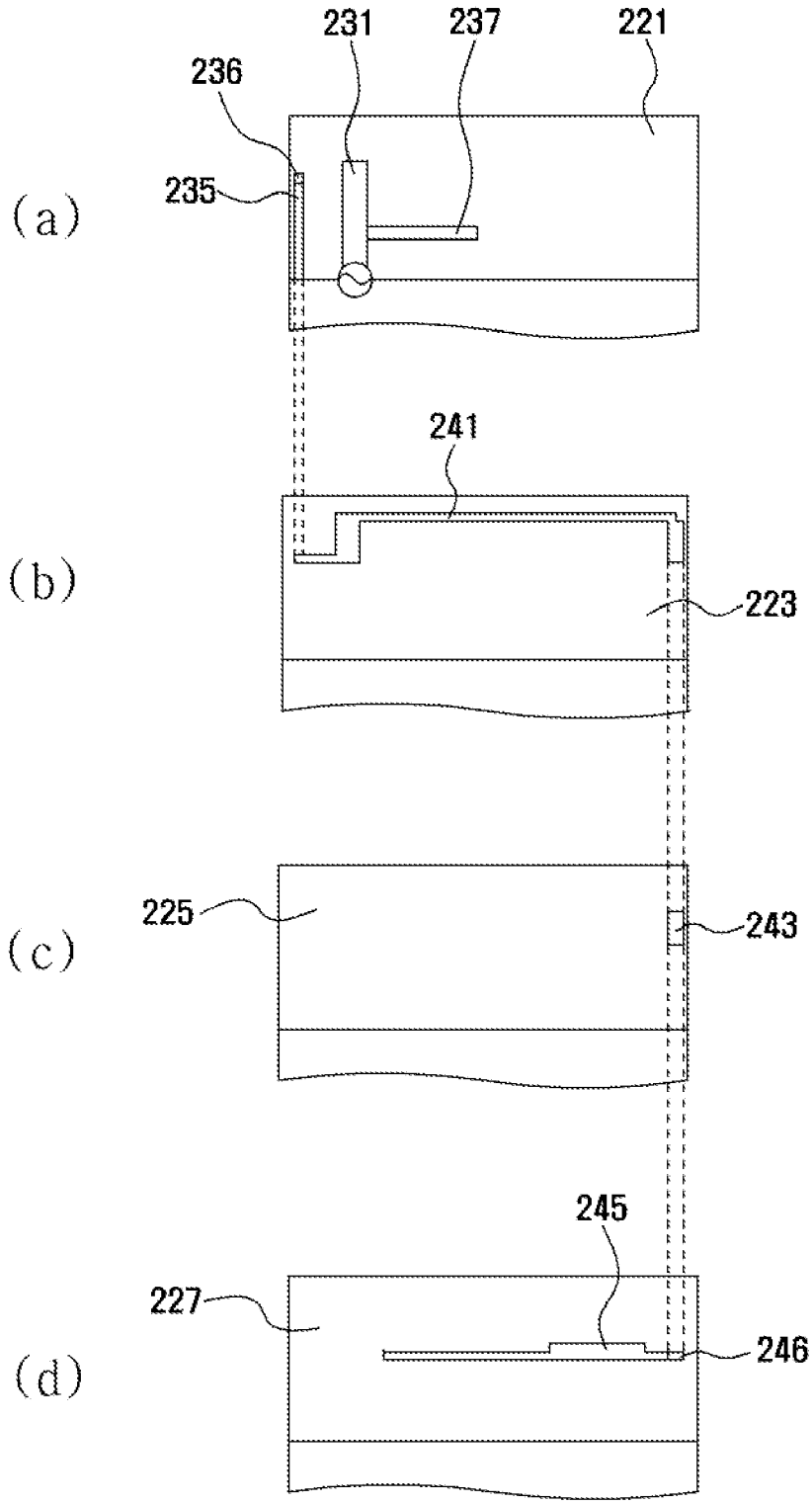
FIG. 9 is an exploded view illustrating an antenna apparatus according to exemplary embodiments of the present invention.

In the foregoing exemplary embodiment of the present invention, a case where an antenna device is formed in a surface of a substrate body is described. However the present invention is not limited thereto. That is, a portion of the antenna device may be inserted into the substrate body. For example, the substrate body may be formed with a plurality of dielectric plates, and at least a portion of the antenna device may be inserted between the dielectric plates. In the foregoing exemplary embodiment of the present invention, a case where a radiation line is formed in an integral form is described. However, the present invention is not limited thereto. That is, the radiation line may be formed as a plurality of partial lines. For example, if the partial lines are separated from each other, the partial lines may be electrically connected. Thus, the partial lines may be operated as a radiation line. FIGS. 8 and 9 illustrate an example of a portion of the antenna device inserted into the substrate body and the radiation line formed as a plurality of partial lines, and illustrate an antenna apparatus according to an exemplary embodiment of the present invention.

FIG. 8 is a plan view illustrating an antenna apparatus according to an exemplary embodiment of the present invention. FIG. 9 is an exploded view illustrating an antenna apparatus according to an exemplary embodiment of the present invention.

In an exemplary implementation, an antenna apparatus is formed in a PCB.

Referring to FIGS. 8 and 9, a multi-band antenna apparatus 200 includes a substrate body 210, antenna device 230, and ground plate 250.

The substrate body 210 is provided to support the antenna apparatus 200. The substrate body 210 is formed in a flat plate structure having both surfaces and at least four corners. The substrate body 210 is formed as a dielectric body. In this case, the substrate body 210 is formed by stacking a plurality of dielectric plates 221, 223, 225 and 227, for example, a first plate 221, a second plate 223, a third plate 225 and a fourth plate 227. Here, the first plate 221 is stacked on the second plate 223, the second plate 223 is stacked on the third plate 225 and the third plate 225 is stacked on the fourth plates 227. Further, the substrate body 210 has a transmission line (not illustrated). The transmission line is connected to an external power source (not illustrated) of the antenna apparatus 200 through one end portion.

In the substrate body 210, an upper surface of each of the dielectric plates 211, 213, 215 and 217 is divided into an upper element area 211 and an upper ground area 213. The upper element area 211 is disposed to include two corners of the upper surface, and the upper ground area 213 is disposed to include the remaining corners of the upper surface. The upper element area 211 of the dielectric plates 211, 213, 215 and 217 is disposed at an area perpendicular to an upper surface of the substrate body 210. Further, a lower surface of each of the dielectric plates 211, 213, 215 and 217 is divided into a lower element area 215 and a lower ground area 217. The lower element area 215 is disposed at an area corresponding to the upper element area 211 in the lower surface, and the lower ground area 217 is disposed at an area corresponding to the upper ground area 213 in the lower surface.

The antenna device 230 is provided to transmit and receive a signal of a preset frequency band in the antenna apparatus 200. That is, the antenna device 230 resonates with a preset frequency band, thereby transmitting a signal. In this case, the antenna device 230 resonates in a preset reference impedance. The antenna device 230 is formed on a surface of the substrate body 210 or inserted into the substrate body 210. In this case, the antenna device 130 is formed by patterning a metal material in a surface of at least one of the dielectric plates 211, 213, 215 and 217. The antenna device 230 includes a power supply line 231, a radiation line 233, a ground line 235 and a branch line 237.

The power supply line 231 is provided to supply power in the antenna device 230. The power supply line 231 is disposed at one of the dielectric plates 211, 213, 215 and 217 of the substrate body 210, for example, at the upper element area 211 of the first plate 221, as illustrated in (a) of FIG. 9. In this case, the power supply line 231 is connected to another end portion of the transmission line. The power supply line 231 is formed in a bar form extended from the transmission line in an upper surface of the substrate body 210. Alternatively, the power supply line 231 may be formed in a structure having at least one folded portion. The power supply line 231 may be formed in at least one of a meander type, a spiral type, a step type, a loop type, and the like. That is, the power supply line 231 is connected to the transmission line through one end portion and is opened through the other end portion. Accordingly, when power is supplied through the transmission line from an external power source, the power supply line 231 forms an electromagnetic field in a peripheral area within a preset distance.

The radiation line 233 is provided to radiate in the antenna device 230. The radiation line 233 is formed with a plurality of partial lines 241, 243 and 245, for example, a first partial line 241, a second partial line 243, and a third partial line 245. In this case, the partial lines 241, 243 and 245 are dispersed in different dielectric plates 211, 213, 215 and 217. Here, one of the partial lines 241, 243 and 245 is separated using another line, such as a neighboring line and at least one of the dielectric plates 211, 213, 215 and 217 as the boundary. One of the partial lines 241, 243 and 245 is overlapped along one axis perpendicular to an upper surface of the substrate body 210 in the neighboring line and at least one of the dielectric plates 211, 213, 215 and 217. Alternatively, one of the partial lines 241, 243 and 245 may penetrate and have contact with the neighboring line and at least one of the dielectric plates 211, 213, 215 and 217.

For example, as illustrated in (b) of FIG. 9, the first partial line 241 is disposed at the upper element area 211 of the second plate 223. In this case, the first partial line 241 is separated using the first plate 221 as the boundary through at least an end portion and is overlapped with the other end portion of the power supply line 231. The first partial line 241 is formed in a bar form extended from the power supply line 231. Alternatively, the first partial line 241 may be formed in a structure having at least one folded portion. The first partial line 241 may be formed in at least one of a meander type, a spiral type, a step type, a loop type, and the like. That is, the first partial line 241 is overlapped with the power supply line 231 through one end portion and is opened through another end portion. Accordingly, when an electromagnetic field is formed in the power supply line 231, the power supply line 231 and the first partial line 241 are in an excited state through an overlapping area. That is, magnetic coupling is performed between the power supply line 231 and the first partial line 241.

The second partial line 243 is disposed at the upper element area 211 of the third plate 225, as illustrated in (c) of FIG. 9. In this case, the second partial line 243 is separated using the second plate 223 as the boundary through at least an end portion and is overlapped with the other end portion of the first partial line 241. Further, the second partial line 243 is formed in a bar form extended from the first partial line 241. Alternatively, the second partial line 243 may be formed in a structure having at least one folded portion. The second partial line 243 may be formed in at least one of a meander type, a spiral type, a step type, a loop type, and the like. That is, the second partial line 243 is overlapped with the first partial line 241 through one end portion and is opened through the other end portion. Accordingly, when an electromagnetic field is formed in the first partial line 241, the first partial line 241 and the second partial line 243 are in an excited state through an overlapping sub-area 244. That is, magnetic coupling is performed between the first partial line 241 and the second partial line 243.

Further, the third partial line 245 is disposed at the upper element area 211 of the fourth plate 227, as illustrated in (d) of FIG. 9. In this case, the third partial line 245 has radiation via 246 while having contact with the other end portion of the second partial line 243 by penetrating the third plate 225 in one end portion. In addition, the third partial line 245 is formed in a bar form extended from the radiation via 246. Alternatively, the third partial line 245 may be formed in a structure having at least one folded portion. The third partial line 245 may be formed in at least one of a meander type, a spiral type, a step type, a loop type, and the like. That is, the third partial line 245 has contact with the second partial line 243 through one end portion and is opened through the other end portion. Accordingly, when magnetic coupling is performed between the first partial line 241 and the second partial line 243, power is supplied to the third partial line 245 through the second partial line 243.

The ground line 235 is provided to ground in the antenna device 230. The ground line 235 is disposed at one of the dielectric plates 211, 213, 215 and 217 of the substrate body 210, for example, at the upper element area 211 of the first plate 221, as illustrated in (a) of FIG. 9. In this case, the ground line 235 has contact with the radiation line 233 through one end portion and connects the radiation line 233 to the ground plate 250. The ground line 235 is formed in a bar form extended from the radiation line 233 in a lower surface of the substrate body 210. Alternatively, the ground line 235 may be formed in a structure having at least one folded portion. The ground line 235 may be formed in at least one of a meander type, a spiral type, a step type, a loop type and the like. That is, the ground line 235 has contact with the radiation line 133 through one end portion and contact with the ground plate 250 through the other end portion.

When the ground line 235 is disposed at the dielectric plates 211, 213, 215 and 217, which is different from the radiation line 233, the ground line 235 has a ground via 236 while having contact with the second partial line 243 by penetrating the dielectric plates 211, 213, 215 and 217, for example, the second plate 213 in one end portion. Alternatively, although not illustrated, when the ground line 235 is disposed at the dielectric plates 211, 213, 215 and 217, which is different from the ground plate 250, the ground line 235 may have a ground via 236 while having contact with the ground plate 250 by penetrating at least one of the dielectric plates 211, 213, 215 and 217 in the other end portion.

The branch line 237 is provided to minutely adjust performance in the antenna device 230. The branch line 237 is formed to protrude from the power supply line 231 or the radiation line 233, as illustrated in (a) of FIG. 9. The branch line 237 is formed in a bar form extended from the power supply line 231 or the radiation line 233 in one of the dielectric plates 211, 213, 215 and 217. Alternatively, the branch line 237 may be formed in a structure having at least one folded portion. The branch line 237 may be formed in at least one of a meander type, a spiral type, a step type, a loop type, and the like. That is, the branch line 237 is connected to the power supply line 231 or the radiation line 233 through one end portion and is opened through another end portion. Accordingly, when power is supplied through the power supply line 231 or the radiation line 233, the branch line 237 resonates together with the radiation line 233.

The ground plate 250 is provided to ground the antenna apparatus 200. The ground plate 250 is disposed at a surface of the substrate body 210, for example, at least one of the upper ground area 213 of the first plate 221 and the lower ground area 217 of the fourth plate 227. In this case, the ground plate 250 is formed to cover at least one of the upper ground area 213 and the lower ground area 217. The ground plate 250 has contact with the antenna device 230, for example the ground line 235. Accordingly, when power is supplied to the antenna device 230, the ground plate 250 grounds the antenna device 230.

An operation characteristic of the antenna apparatus 200 according to an exemplary embodiment of the present invention is similar to the operation characteristic of the foregoing exemplary embodiment of the present invention. Thus, a detailed description thereof is omitted. That is, the antenna apparatus 200 resonates in a plurality of frequency bands. In this case, the antenna apparatus 200 resonates in a low frequency band including an LTE communication band, CDMA and GSM communication bands, and an EGSM communication band. Further, the antenna apparatus 200 resonates in a high frequency band including a DCS communication band and a PCS communication band. The antenna apparatus 200 resonates in relative high performance in each of a low frequency band and a high frequency band, and sustains relatively high operation efficiency.

Further, in an exemplary implementation, by tuning the antenna apparatus 200, an operation characteristic may be minutely adjusted.

FIGS. 10A, 10B, 10C, 10D and 10E are diagrams illustrating a change of an operation characteristic by tuning an antenna apparatus according to an exemplary embodiment of the present invention. In this case, FIGS. 10A, 10B, 10C, 10D and 10E represent a change of an S parameter according to a frequency band.

Figure 10A:
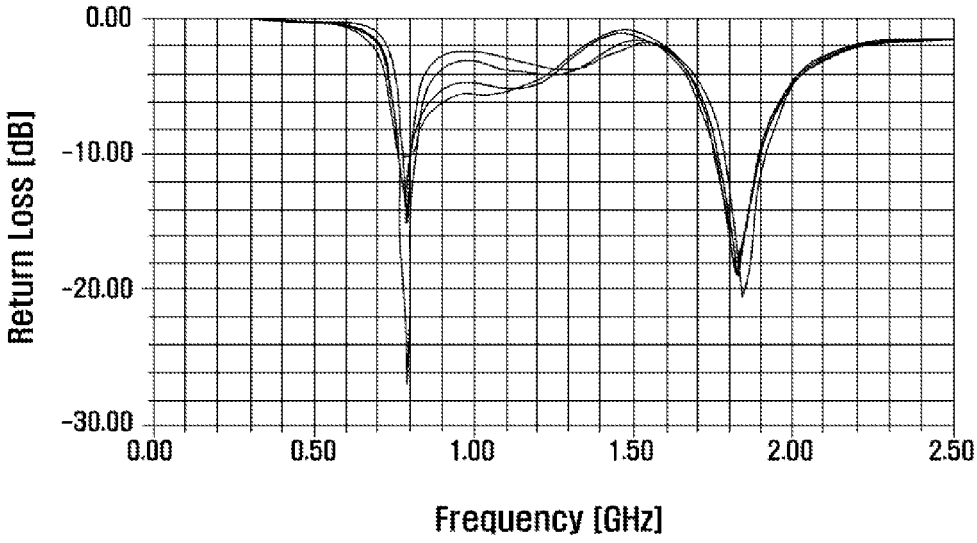
FIGS. 10A, 10B, 10C, 10D and 10E are diagrams illustrating a change of an operation characteristic according to tuning of the antenna apparatus according to an exemplary embodiment of the present invention.

Referring to FIG. 10A, in the antenna apparatus 200, by adjusting an overlapping area 234 between the power supply line 231 and the radiation line 233, a low frequency band may be adjusted. In this case, in the antenna apparatus 200, by enlarging or reducing an area of the overlapping area 134, a characteristic of a parallel capacitor may be changed. Thereby, in the antenna apparatus 200, a bandwidth of a low frequency band may be enlarged or reduced, or resonance performance may be improved or deteriorated. In this case, even if an overlapping area 234 between the power supply line 231 and the radiation line 233 is adjusted, a high frequency band may be sustained without any change.

Figure 10B:
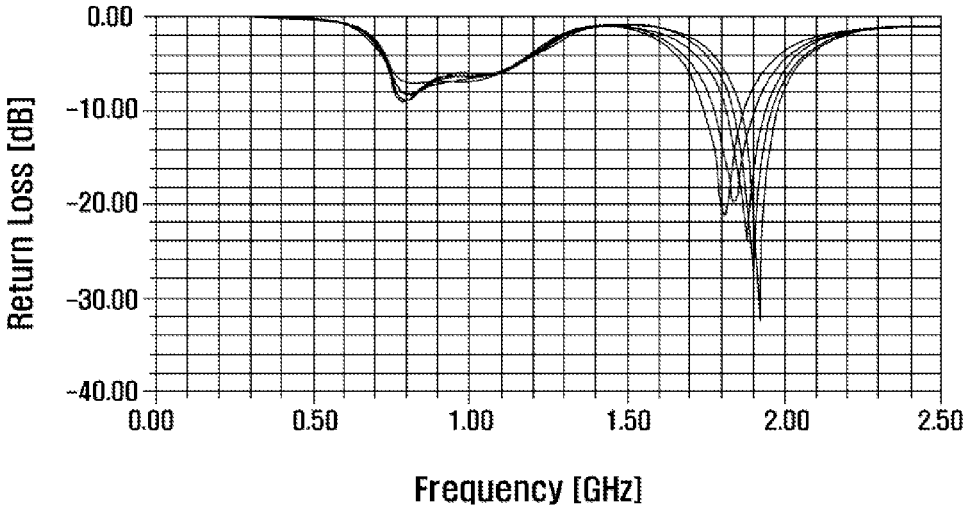

Referring to FIG. 10B, in the antenna apparatus 200, by adjusting a size of the branch line 237, a high frequency band may be adjusted. In the antenna apparatus 200, by enlarging or reducing a length or a width of the branch line 237, a characteristic of a parallel inductor or a serial capacitor may be changed. Thereby, in the antenna apparatus 200, a bandwidth of a high frequency band may be enlarged or reduced, or resonance performance may be improved or deteriorated. In this case, even if a size of the branch line 237 is adjusted, a low frequency band may be sustained without any change.

Figure 10C:
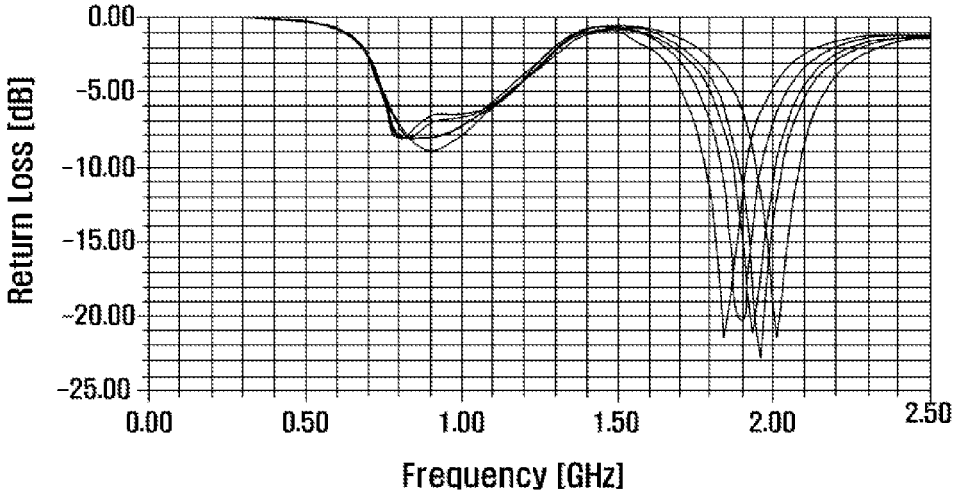

Referring to FIG. 10C, in the antenna apparatus 200, by adjusting a size of the radiation line 233, a high frequency band may be adjusted. In the antenna apparatus 200, by enlarging or reducing a length or a width of the radiation line 233, a characteristic of a parallel inductor or a serial capacitor may be changed. Thereby, in the antenna apparatus 200, a bandwidth of a high frequency band may be enlarged or reduced, or resonance performance may be improved or deteriorated. In this case, even if a size of the radiation line 233 is adjusted, a low frequency band may be sustained without any change.

Figure 10D:
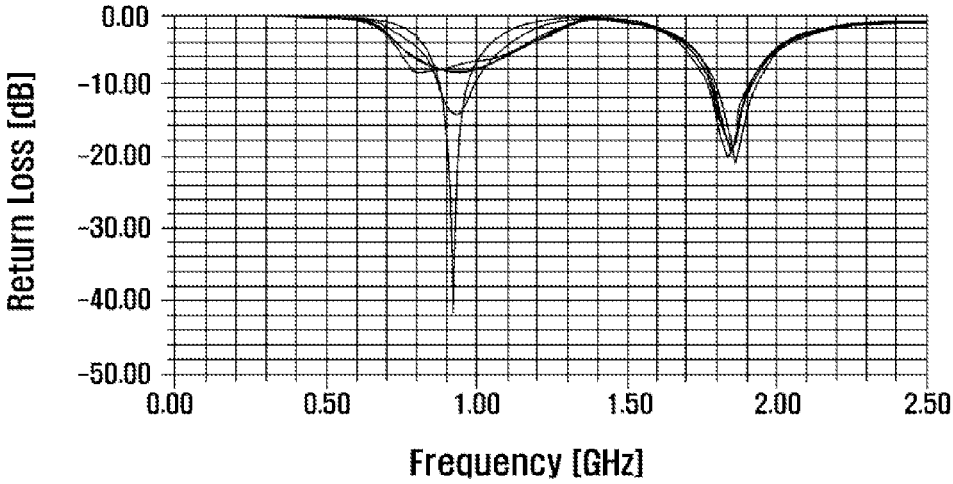

Referring to FIG. 10D, in the antenna apparatus 200, by adjusting an overlapping area 234 between the power supply line 231 and the radiation line 233, a low frequency band may be adjusted. In the antenna apparatus 200, by enlarging or reducing a separation thickness of the overlapping area 134, a characteristic of a parallel capacitor may be changed. Thereby, in the antenna apparatus 200, a bandwidth of a low frequency band may be enlarged or reduced, or a resonance performance may be improved or deteriorated. In this case, even if the overlapping area 234 between the power supply line 231 and the radiation line 233 is adjusted, a high frequency band may be sustained without any change.

Figure 10E:
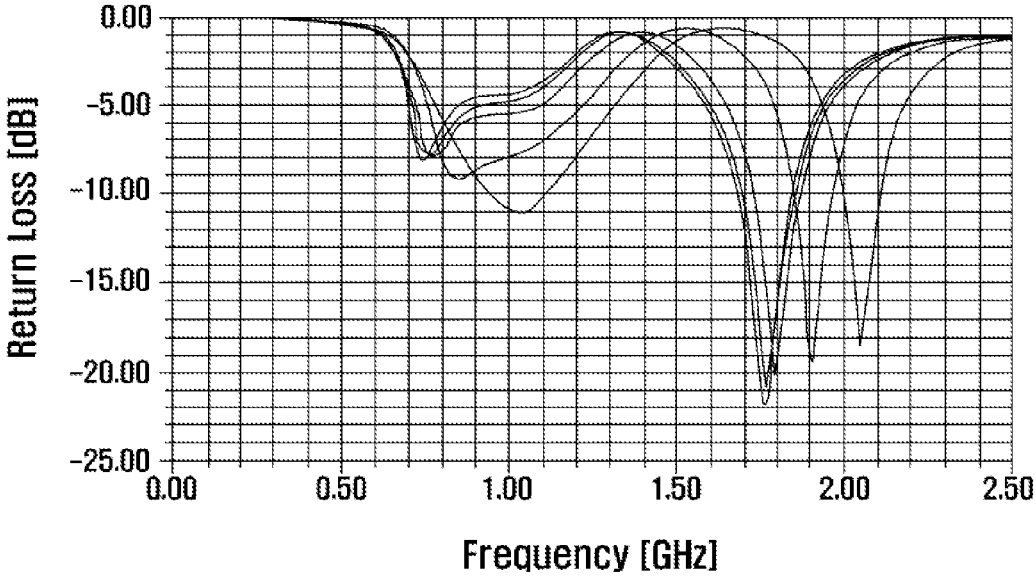

Referring to FIG. 10E, in the antenna apparatus 200, by adjusting an overlapping sub-area 244 of the radiation line 233, a low frequency band and a high frequency band may be adjusted. In this case, in the antenna apparatus 200, by enlarging or reducing an area of the overlapping sub-area 244, a characteristic of a parallel capacitor, a parallel inductor, or a serial capacitor may be changed. Thereby, in the antenna apparatus 200, a bandwidth of a low frequency band may be enlarged or reduced, or resonance performance may be improved or deteriorated, and a bandwidth of a high frequency band may be enlarged or reduced, or resonance performance may be improved or deteriorated.

As described above, in a multi-band antenna apparatus according to exemplary embodiments of the present invention, a power supply line and a radiation line are formed in an overlapped structure separated from each other. Thus, an available frequency band may be further extended. That is, in the antenna apparatus, a plurality of frequency bands, i.e., a low frequency band as well as a high frequency band may be used. In this case, in the antenna apparatus, an LTE communication band, CDMA and GSM communication bands, an EGSM communication band, a DCS communication band, and a PCS communication band can be used, and at least five frequency bands (penta-band) can be used.

While the invention as been shown and described with reference to certain exemplary embodiments thereof, it will be understood by those skilled in the art that various changes in the form and details may be made therein without departing from the spirit and scope of the invention as defined by the appended claims and their equivalents.

What is claimed is:

1. An antenna apparatus using a multiple frequency band, the apparatus comprising:

a substrate body formed in a flat plate structure comprising a preset thickness and in which at least one dielectric plate is stacked;

a power supply line, disposed at the substrate body and connected to an external power source, for forming an electromagnetic field when power is supplied from the external power source;

a radiation line, separated from the power supply line using the dielectric plate as a boundary in the substrate body, for forming an overlapping area overlapped with the power supply line along one axis through at least an end portion, and for resonating in a frequency band determined according to the overlapping area when the electromagnetic field is formed; and a ground plate, disposed in at least one of an upper ground area and a lower ground area of the substrate body, for grounding the radiation line while having contact with the radiation line.

2. The apparatus of claim 1, wherein the frequency band is determined by at least one of an area of the overlapping area and a separation thickness of the overlapping area according to the substrate body.

3. The apparatus of claim 1, wherein the radiation line is formed with a plurality of partial lines dispersed using at least one of the dielectric plates as the boundary.

4. The apparatus of claim 3, wherein one of the partial lines forms an overlapping sub-area overlapped along one axis using a neighboring line among the partial lines and at least one of the dielectric plates as the boundary.

5. The apparatus of claim 4, wherein the frequency band is at least one of determined by at least one of separation thicknesses of the overlapping sub-area according to an area of the overlapping sub-area and determined by at least one of the dielectric plates.

6. The apparatus of claim 3, wherein one of the partial lines comprises a radiation line while having contact with a neighboring line of the partial lines by penetrating at least one of the dielectric plates.

7. The apparatus of claim 1, further comprising a ground line for connecting the radiation line and the ground plate.

8. The apparatus of claim 7, wherein the ground line is disposed at any one of the dielectric plates different from the radiation line and has contact with the radiation line by penetrating at least one of the dielectric plates.

9. The apparatus of claim 7, wherein the ground line is disposed at one dielectric plate different from the ground plate and has contact with the ground plate by penetrating at least one of the dielectric plates.

10. The apparatus of claim 1, further comprising at least one of a branch line protruded from at least one of the power supply line and the radiation line, for resonating together with the radiation line.

11. An antenna apparatus including a substrate body using a multiple frequency band, the apparatus comprising:

a power supply line, disposed at the substrate body and connected to an external power source, for forming an electromagnetic field when power is supplied from the external power source;

a radiation line, separated from the power supply line using the dielectric plate as a boundary in the substrate body, for forming an overlapping area overlapped with the power supply line along one axis through at least an end portion, and for resonating in a frequency band determined according to the overlapping area when the electromagnetic field is formed;

a ground plate, disposed in at least one of an upper ground area and a lower ground area of the substrate body, for grounding the radiation line while having contact with the radiation line; and a ground line for connecting the radiation line and the ground plate.

12. The apparatus of claim 11, wherein the substrate body is formed in a flat plate structure comprising a preset thickness and in which at least one dielectric plate is stacked.

13. The apparatus of claim 11, wherein the frequency band is determined by at least one of an area of the overlapping area and a separation thickness of the overlapping area according to the substrate body.

14. The apparatus of claim 11, wherein the radiation line is formed with a plurality of partial lines dispersed using at least one of the dielectric plates as the boundary.

15. The apparatus of claim 14, wherein one of the partial lines forms an overlapping sub-area overlapped along one axis using a neighboring line among the partial lines and at least one of the dielectric plates as the boundary.

16. The apparatus of claim 15, wherein the frequency band is at least one of determined by at least one of separation thicknesses of the overlapping sub-area according to an area of the overlapping sub-area and determined by at least one of the dielectric plates.

17. The apparatus of claim 14, wherein one of the partial lines comprises a radiation line while having contact with a neighboring line of the partial lines by penetrating at least one of the dielectric plates.

18. The apparatus of claim 11, wherein the ground line is disposed at any one of the dielectric plates different from the radiation line and has contact with the radiation line by penetrating at least one of the dielectric plates.

19. The apparatus of claim 11, wherein the ground line is disposed at one dielectric plate different from the ground plate and has contact with the ground plate by penetrating at least one of the dielectric plates.

20. The apparatus of claim 11, further comprising at least one of a branch line protruded from at least one of the power supply line and the radiation line, for resonating together with the radiation line.

* * * * *